US010494730B2

(12) United States Patent
Tao et al.

(10) Patent No.: US 10,494,730 B2
(45) Date of Patent: Dec. 3, 2019

(54) SURFACE COLOR TREATMENT OF ALLOYS WITH MICRO-ARC OXIDATION PROCESS

(71) Applicant: Nano and Advanced Materials Institute Limited, Hong Kong (CN)

(72) Inventors: Hong Tao, Hong Kong (CN); King Ho So, Hong Kong (CN); Echo Siyue Li, Hong Kong (CN); Qiu Jin, Hong Kong (CN)

(73) Assignee: NANO AND ADVANCED MATERIALS INSTITUTE LTD, Hong Kong (CN)

( * ) Notice: Subject to any disclaimer, the term of this patent is extended or adjusted under 35 U.S.C. 154(b) by 222 days.

(21) Appl. No.: 15/584,050

(22) Filed: May 2, 2017

(65) Prior Publication Data

US 2017/0314155 A1 Nov. 2, 2017

Related U.S. Application Data

(60) Provisional application No. 62/391,478, filed on May 2, 2016.

(51) Int. Cl.

| | |
|---|---|
| ***C22C 21/10*** | (2006.01) |
| ***C25D 11/14*** | (2006.01) |
| ***C22C 23/02*** | (2006.01) |
| ***C25D 11/06*** | (2006.01) |
| ***C25D 11/30*** | (2006.01) |

(52) U.S. Cl.

CPC ..... *C25D 11/14* (2013.01); *C22C 21/10* (2013.01); *C22C 23/02* (2013.01); *C25D 11/06* (2013.01); *C25D 11/30* (2013.01)

(58) Field of Classification Search

None

See application file for complete search history.

(56) References Cited

U.S. PATENT DOCUMENTS

| | | | |
|---|---|---|---|
| 2008/0221263 | A1 | 9/2008 | Kanagasabapathy et al. |
| 2011/0094417 | A1 | 4/2011 | Baumgart et al. |

FOREIGN PATENT DOCUMENTS

| | | | |
|---|---|---|---|
| CN | 1824846 | A | 8/2006 |
| CN | 1873059 | A | 12/2006 |
| CN | 1936099 | * | 3/2007 |
| CN | 101423945 | | 11/2007 |
| CN | 101270495 | A | 9/2008 |
| CN | 101307477 | A | 11/2008 |
| CN | 101466481 | | 6/2009 |

(Continued)

OTHER PUBLICATIONS

J.E. Gray, B. Luan, Protective coatings on magnesium and its alloys—a critical review, Journal of Alloys and Compounds 336 (2002) pp. 88-113.

(Continued)

*Primary Examiner* — Daniel J. Schleis

(74) *Attorney, Agent, or Firm* — Eagle IP Limited; Jacqueline C. Lui

(57) ABSTRACT

Example embodiments include methods of treating a surface of an aluminum (Al) alloy or magnesium (Mg) with an electrolyte to obtain a surface with a coloration that is uniformly enhanced. Example embodiments also include surface-treated Al alloy or Mg alloy made by the example methods.

9 Claims, 15 Drawing Sheets
(10 of 15 Drawing Sheet(s) Filed in Color)

(56) References Cited

FOREIGN PATENT DOCUMENTS

| | | | |
|---|---|---|---|
| CN | 101476142 | | 7/2009 |
| CN | 101985768 | | 3/2011 |
| CN | 101985768 | A | 3/2011 |
| CN | 102345126 | | 2/2012 |
| CN | 102703955 | A | 10/2012 |
| CN | 102286768 | | 2/2013 |
| JP | 2011184726 | * | 9/2011 |

OTHER PUBLICATIONS

Hong Tao, King Ho So, Echo Li, Xuezhu Zhang, Gary Lai, Surface modifications of Mg alloys based on micro-arc oxidation methods from manufacturing perspectives, Applied Mechanics and Materials 548-549 (2014) pp. 284-288.

Wang et al "Preparation of superhydrophobic silica film on Mg—Nd—Zn—Zr magnesium alloy with enhanced corrosion resistance by combining micro-arc oxidation and sol-gel method" Surface & Coatings Technology 213 (2012) p. 192-201.

Wu et al "Using Micro-Arc Oxidization and Alkali Etching to Produce Nanoporous TiO2 Layer on Titanium Foil for Flexible Dye-Sensitized Solar Cell Application" Japanese Journal of Applied Physics 49 (2010) 092301 pp. 1-4.

Liang et al "Fabrication of Superhydrophobic Surface on Magnesium Alloy" Chemistry Letters vol. 36, No. 3 (2007) p. 416-417.

Song et al "Fabrication of functionalized aluminium compound petallike structure with superhydrophobic surface" Surf. Interface. Anal. 2010, 42, 165-168.

Brinker et al "Fundamentals of Sol-gel Dip Coating", Thin Solid Films, 201 (1991) 97-108.

Lamaka et al "Novel hybrid sol-gel coatings for corrosion protection of AZ31B magnesium alloy" Electrochimica Acta 53 (2008) 4773-4783.

http://www.supplieronline.com/propertypages/AZ31B.asp; captured Oct. 12, 2016.

Ishizaki et al "Rapid Formation of a Superhydrophobic Surface on a Magnesium Alloy Coated With a Cerium Oxide Film by a Simple Immersion Process at Room Temperature and Its Chemical Stability" Langmuir 2010, 26 (12), 9749-9755.

Hao et al., "Color Characteristic and Formation Mechanism of Black Ceramic Coating by Micro Arc Oxidation on 1060 Aluminum Alloy," Surface Technology, vol. 43, Issue 1, pp. 44-49.

* cited by examiner

Ti Ka1

Ti Ka1

600

| Element | Compositions in Al 7075 |
|---|---|
| Zn | 5.6-6.1 % |
| Mg | 2.1-2.5 % |
| Cu | 1.2-1.6 % |
| Al | Balance |

Figure 6A

602

| Element | Compositions in Mg AZ31B | Compositions in Mg AZ91D |
|---|---|---|
| Al | 3.17 % | 8.3-9.7 % |
| Zn | 0.78 % | 0.35-1.0 % |
| Mn | 0.31 % | 0.15-0.50 % |
| Mg | Balance | Balance |

Figure 6B

SURFACE COLOR TREATMENT OF ALLOYS WITH MICRO-ARC OXIDATION PROCESS

FIELD OF THE INVENTION

This invention relates to micro-arc oxidation (MAO) treatment process with surface coloration on magnesium (Mg) alloys and/or aluminum (Al) alloys.

BACKGROUND

Micro-arc oxidation (MAO) treatment is promising and efficient to form thick ceramic layers with good adhesion to the substrate, which is also environmental friendly with good cost efficiency. Manufacturers, however, are often not satisfied with the MAO process since it generates an unwanted color on the treated surface. Current methods attempt to modify the surface color but require additional processes that are inefficient and time consuming.

Therefore, there is a need to provide a surface color treatment method with the MAO process on alloys.

SUMMARY OF THE INVENTION

One example embodiment is a method of treating a surface of an aluminum (Al) alloy, which includes immersing the Al alloy into an electrolyte; and applying an electric current with a current density of 0.03-0.17 A/cm$^2$ and a pulse frequency of 500-2,600 Hz on the Al alloy for a time duration of 100-720 seconds. The Al alloy includes at least 90 weight percent of Al. The electrolyte is a mixture of 10-30 g/L silicate, 3-6 g/L hydroxide, and 8-40 g/L tungstate in deionized (DI) water. A color of the surface of the Al alloy that is treated by the method is uniformly enhanced.

Another example embodiment is a method of treating the surface of magnesium (Mg) alloy, which includes immersing the Mg alloy into an electrolyte; and applying an electric current with current density of 0.03-0.17 A/cm$^2$ and a pulse frequency of 500-2,600 Hz on the Mg alloy for a time duration of 100-720 seconds. The Mg alloy comprises at least 90 weight percent of Mg. The electrolyte is a mixture of 20-30 g/L silicates, 5-20 g/L phosphate, 3-6 g/L hydroxide, 5-10 g/L glycerol, 0.5-2 g/L tungstate, and 5-15 g/L titanium dioxide ($TiO_2$) nanoparticles in deionized (DI) water. A color of the surface of the Mg alloy that is treated by the method is uniformly enhanced.

Other example embodiments are discussed herein.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 6A shows a table that provides chemical compositions of a commercial grade Al alloy 7075 in accordance with an example embodiment.

FIG. 6B shows a table that provides chemical compositions of a commercial grade Mg alloys AZ31B and AZ91D in accordance with an example embodiment.

DETAILED DESCRIPTION

As used herein and in the claims, "comprising" means including the following elements but not excluding others.

EXAMPLE 1: BLACK MAO TREATMENT ON ALUMINIUM ALLOY

Samples made of commercial grade Al alloy 7075 are used in these experiments. By way of example, Table 600 in FIG. 6A shows chemical compositions of the Al alloy 7075. In one example embodiment, a skilled person in the art appreciates that other Al alloys that include at least 90% Al will also be suitable for these experiments.

The Al alloy samples are treated with a micro-arc oxidation (MAO) method. First, an electrolyte for MAO treatment is prepared by dissolving 10-30 g/L silicates and 3-6 g/L hydroxide into deionized (DI) water in a stainless steel bath. Then, an additive 8-40 g/L tungstate is added into the electrolyte. An electric current with a current density of 0.03-0.17 A/cm$^2$ is applied on the Al alloy immersed in the electrolyte with a pulse frequency of 500-2,600 Hz for a time duration of 100-720 seconds. Chemically and mechanically protective Al based ceramic layer is formed on a surface of the Al alloy samples during the process to obtain MAO treated Al alloy. A coating thickness of the Al based ceramic layer is 5-40 um. A color of the MAO treated Al alloy surface is uniformly enhanced.

In an example embodiment, the silicate is sodium metasilicate nonahydrate, the hydroxide is sodium hydroxide, and the tungstate is sodium tungstate.

In an example embodiment, the electrolyte is a mixture of 15 g/L sodium metasilicate nonahydrate, 3 g/L sodium hydroxide and 40 g/L sodium tungstate in DI water; an electric current with a current density of 0.08 A/cm$^2$ and a pulse frequency of 2,600 Hz is applied on the Al alloy for a time duration of 540 seconds. The color of the Al alloy surface is uniformly enhanced to match with the standard color code PANTONE 19-0823 TCX.

Figure 7:
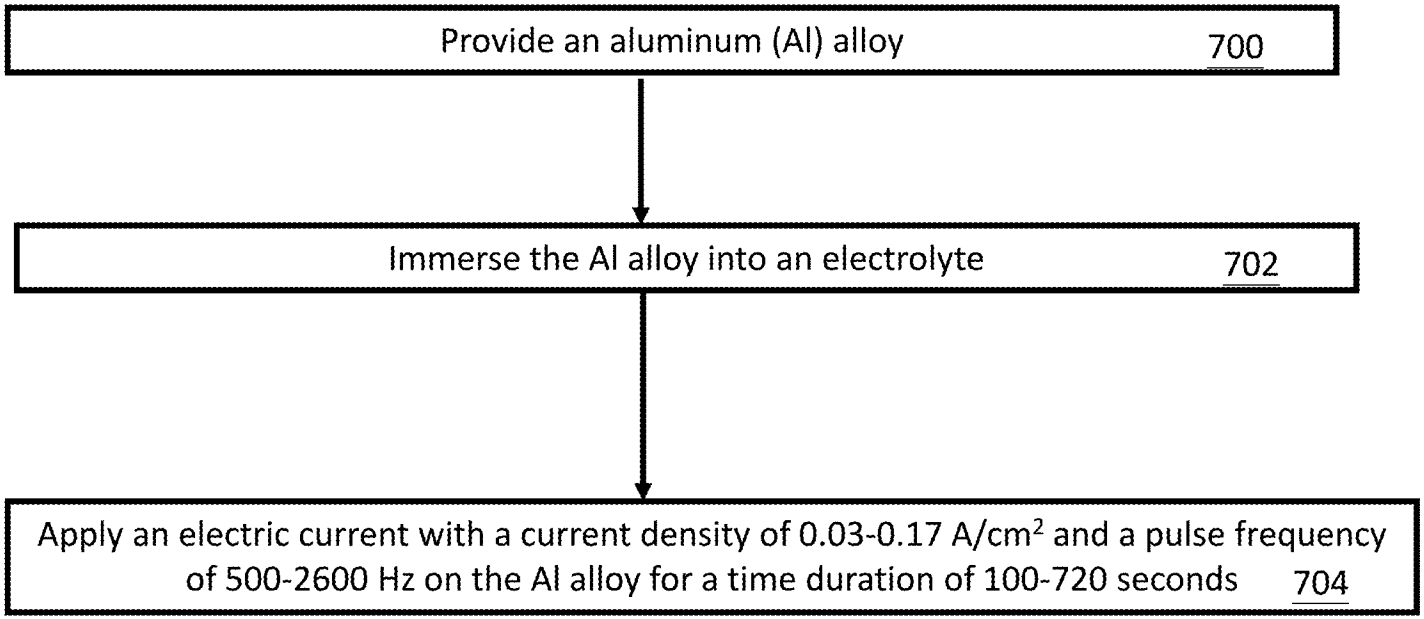
FIG. 7 shows a method of treating a surface an aluminum (Al) alloy in accordance with an example embodiment.

FIG. 7 shows a method of treating a surface an aluminum (Al) alloy.

The Al alloy is provided in box 700.

The Al alloy is immersed into an electrolyte in box 702.

An electric current with a current density of 0.03-0.17 A/cm$^2$ and a pulse frequency of 500-2,600 Hz is applied on the Al alloy for a time duration of 100-720 seconds is applied in box 704.

Figure 1B:
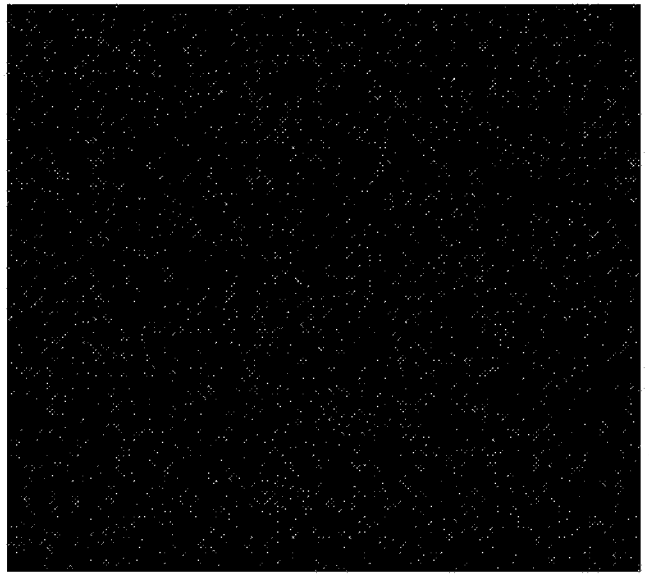
FIG. 1B shows tungstate distribution of a MAO treated Al alloy surface by energy-dispersive X-ray spectroscopy (EDX) in accordance with an example embodiment.
Figure 1A:
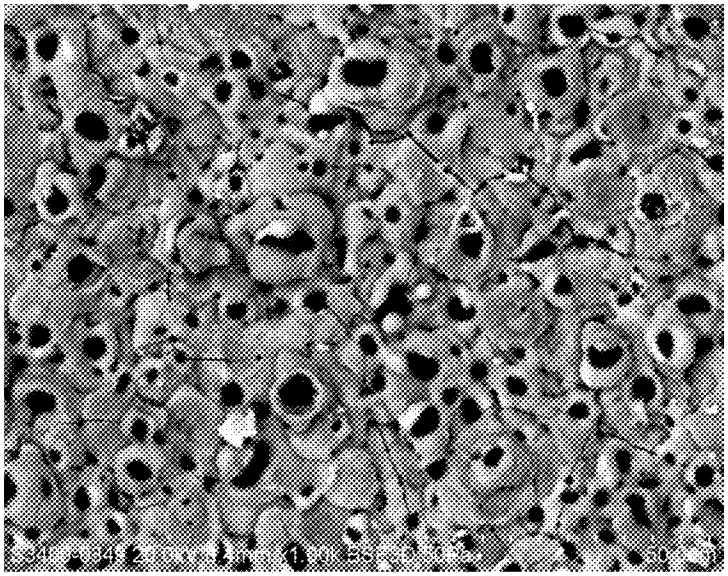
FIG. 1A shows a scanning electron microscope (SEM) image of a MAO treated Al alloy surface in accordance with an example embodiment.

FIG. 1A shows a SEM image of a MAO treated Al alloy surface. FIG. 1B shows an EDX image of a tungstate distribution on the MAO treated Al alloy surface of FIG. 1A.

Figure 2B:
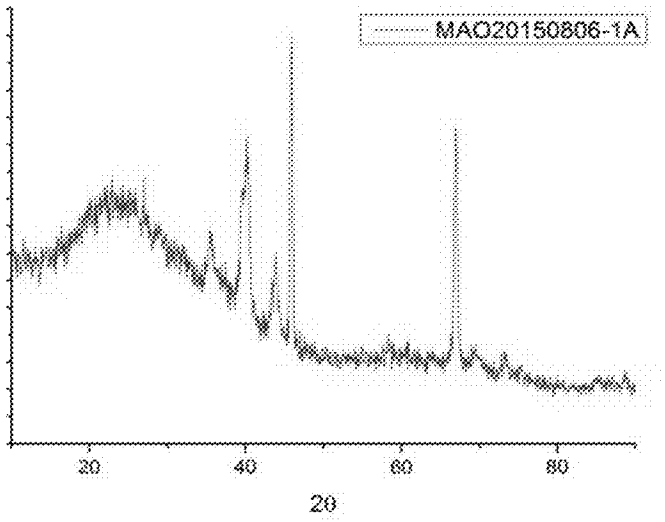
FIG. 2B shows XRD peaks of a MAO treated Al alloy sample with 30 g/L sodium tungstate in accordance with an example embodiment.
Figure 2A:
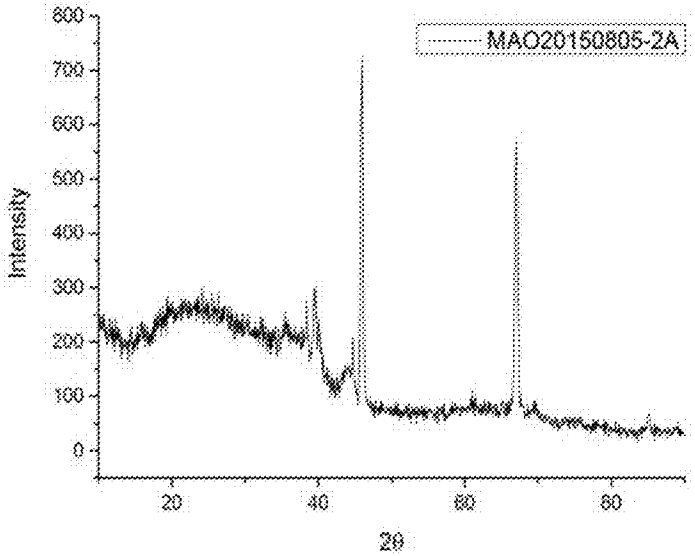
FIG. 2A shows X-ray diffraction (XRD) peaks of a MAO treated Al alloy sample with 8 g/L sodium tungstate in accordance with an example embodiment.

FIG. 2A shows XRD peaks of MAO treated Al alloy samples that are treated with 8 g/L sodium tungstate. FIG. 2B shows XRD peaks of MAO treated Al alloy samples that are treated with 30 g/L sodium tungstate. As observed from these two figures, when more sodium tungstate is added, the amorphous $WO_3$ peak at −23° is found to have a higher intensity. The result indicates that the more tungstate is added into the electrolyte, the darker surface coloration of the MAO treated Al alloy can be obtained.

Figure 5A:
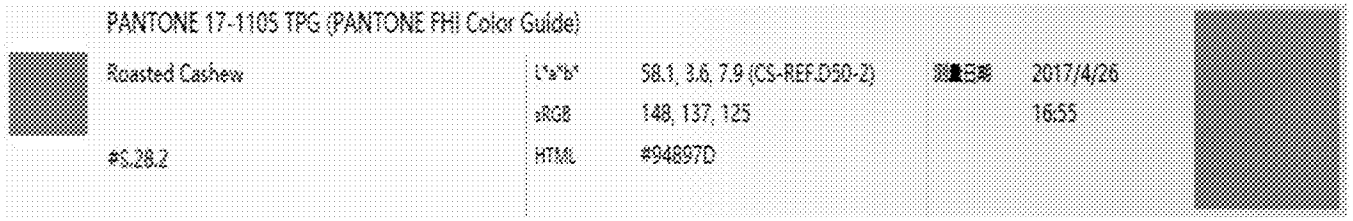
FIG. 5A and FIG. 5B show standard Red Green Blue (sRGB) values of MAO treated Al alloy samples with 8 g/L and 40 g/L sodium tungstate, respectively, in accordance with an example embodiment.
Figure 5B:
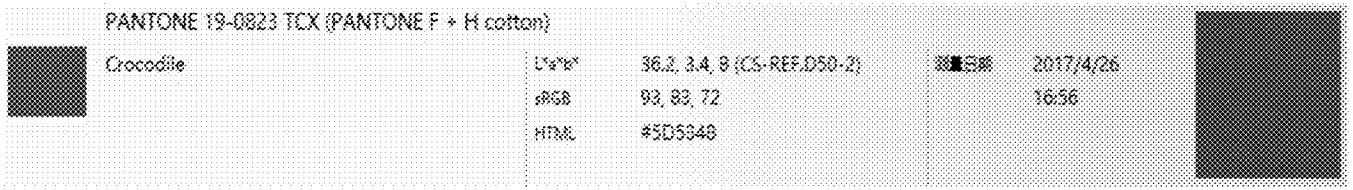

FIG. 5A shows a sRGB value of (148, 137, 125) for the MAO treated Al alloy samples that are treated with 8 g/L sodium tungstate for 540 seconds. FIG. 5B shows a sRGB value of (93, 83, 72) for MAO treated Al alloy samples that are treated with 40 g/L sodium tungstate for 540 seconds. These two figures also indicate that when more sodium tungstate is added, a darker surface coloration of MAO treated Al alloy, as reflected by a smaller sRGB value, can be formed.

Figure 5C:
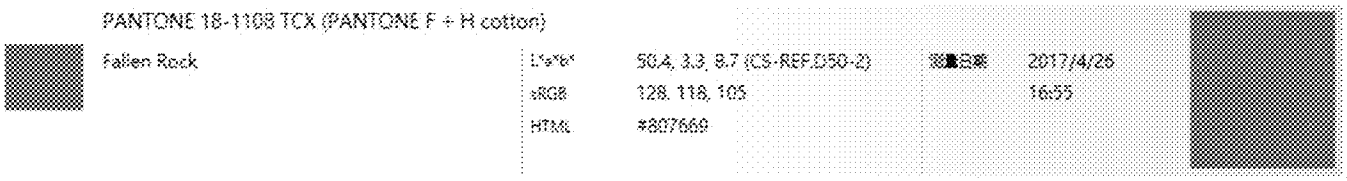
FIG. 5C and FIG. 5D show sRGB values of MAO treated Al alloy samples with 30 g/L sodium tungstate that are processed for 480 seconds and 595 seconds, respectively, in accordance with an example embodiment.
Figure 5D:
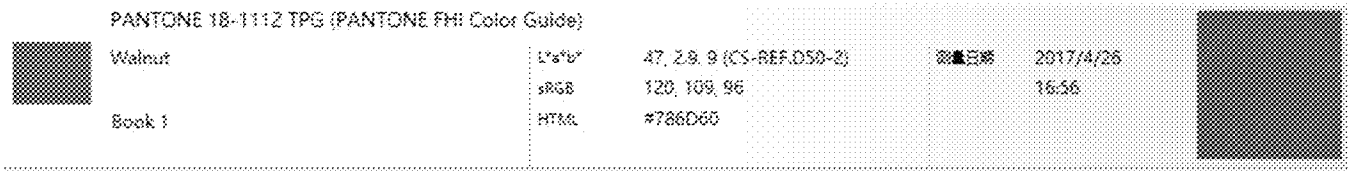

In another example embodiment, the color of the MAO treated Al alloy can be controlled by the MAO treatment time. FIG. 5C shows a sRGB value of (128,118,105) for MAO treated Al alloy samples that are treated with 30 g/L sodium tungstate, and processed for 480 seconds. FIG. 5D shows a sRGB value of (120, 109, 96) for the MAO treated Al alloy samples that are treated with 30 g/L sodium tungstate, and processed for 595 seconds. The result indicates that when the MAO treatment time is longer, a darker surface coloration of MAO treated Al alloy, as reflected by a smaller sRGB value, can be formed.

In another example embodiment, no additional step, such as an annealing step, is required to obtain a MAO treated Al alloy with an enhanced surface coloration.

Figure 4B:
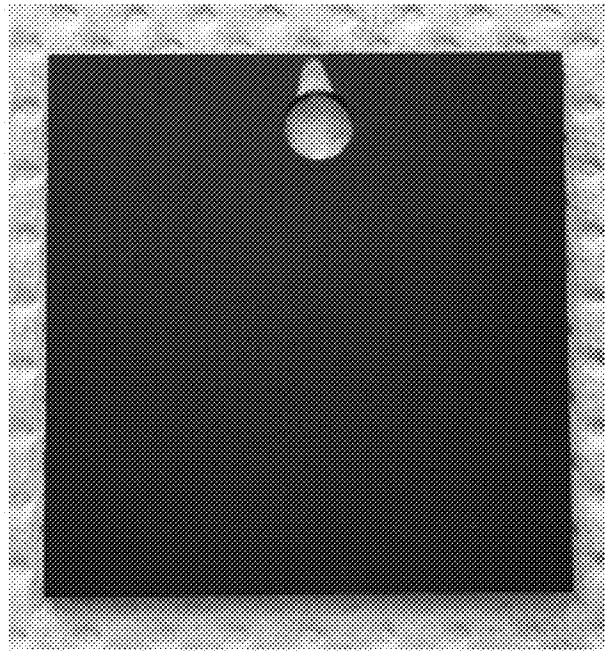
FIG. 4B shows a black MAO treated Mg alloy with a color code of PANTONE 7540 C in accordance with an example embodiment.
Figure 4A:
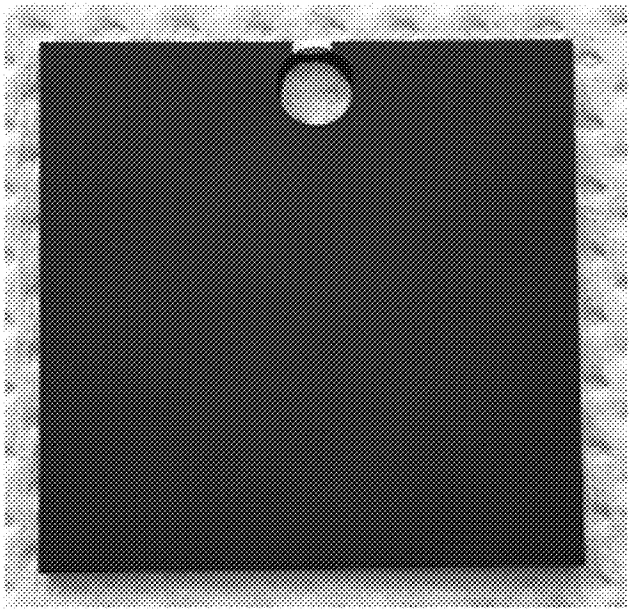
FIG. 4A shows a black MAO treated Al alloy with a color code of PANTONE 19-0823 TCX in accordance with an example embodiment.

In one example embodiment, a MAO treated Al alloy with a standard color code of PANTONE 19-0823 TCX can be obtained when 40 g/L sodium tungstate is added into the electrolyte for MAO treatment, as shown in FIG. 4A.

EXAMPLE 2: BLACK MAO TREATMENT ON MAGNESIUM ALLOY

Samples made of commercial grade Mg alloy AZ31B or AZ91D are used in these experiments. By way of example, Table 602 in FIG. 6B shows chemical compositions of the Mg alloy AZ31B and the Mg alloy AZ91D. In one example embodiment, a skilled person in the art appreciates that other Mg alloys that include at least 90% Mg will also be suitable for these experiments.

The Mg alloy samples are treated with a MAO method. First, an electrolyte for MAO treatment is prepared by dissolving 20-30 g/L silicates, 5-20 g/L phosphates, and 3-6 g/L hydroxide into DI water in a stainless steel bath. Then, additives of 5-10 g/L glycerol, 0.5-2 g/L tungstate, and 5-15 g/L $TiO_2$ nanoparticles are added into the electrolyte. By way of example, the $TiO_2$ nanoparticles added are rutile titanium dioxide with a particle size of 30 nm. An electric current with a current density of 0.03-0.17 A/cm$^2$ and a pulse frequency of 500-2,600 Hz is applied on the Mg alloy samples immersed in the electrolyte for a time duration of 100-720 seconds. Chemically and mechanically protective Mg based ceramic layer is formed on a surface of the Mg alloy samples during the process to obtain MAO treated Mg alloy. A coating thickness of the Mg based ceramic layer is 5-40 um. A color of the MAO treated Mg alloy surface is uniformly enhanced.

In an example embodiment, the silicate is sodium metasilicate nonahydrate, the phosphate is sodium pyrophosphate decahydrate, the hydroxide is sodium hydroxide, and the tungstate is sodium tungstate.

In an example embodiment, Mg alloy AZ31B is used. The electrolyte is a mixture of 30 g/L sodium metasilicate nonahydrate, 10 g/L sodium pyrophosphate decahydrate, 3 g/L sodium hydroxide, 5 g/L glycerol, 0.5 g/L sodium tungstate, and 10 g/L rutile titanium dioxide with a particle size of 30 nm in DI water; an electric current with a current density of 0.17 A/cm$^2$ and a pulse frequency of 2,600 Hz is applied on the Mg alloy sample for a time duration of 150 seconds. The color of the Mg alloy surface is uniformly enhanced to match with the standard color code PANTONE 7540C.

Figure 8:
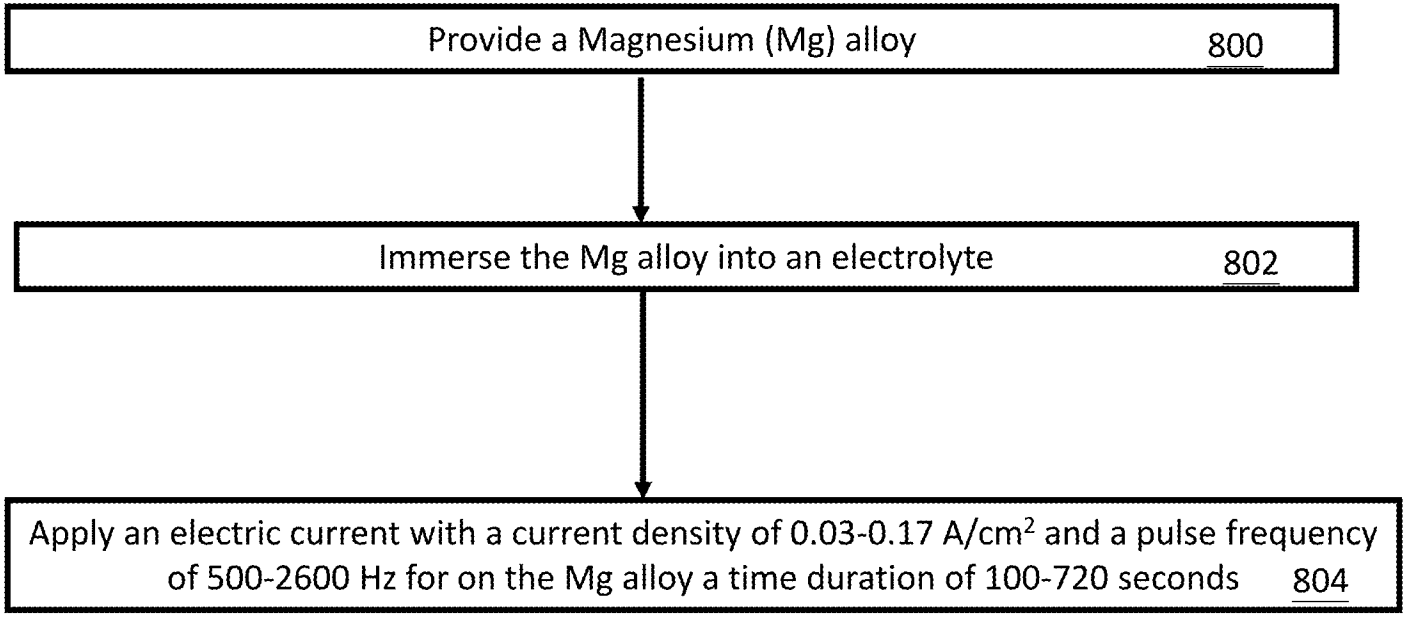
FIG. 8 shows a method of treating a surface a magnesium (Mg) alloy in accordance with an example embodiment.

FIG. 8 shows a method of treating a surface a Magnesium (Mg) alloy.

The Mg alloy is provided in box 800.

The Mg alloy is immersed into an electrolyte in box 802.

An electric current with a current density of 0.03-0.17 A/cm$^2$ and a pulse frequency of 500-2,600 Hz on the Mg alloy for a time duration of 100-720 seconds is applied in box 804.

Figure 1D:
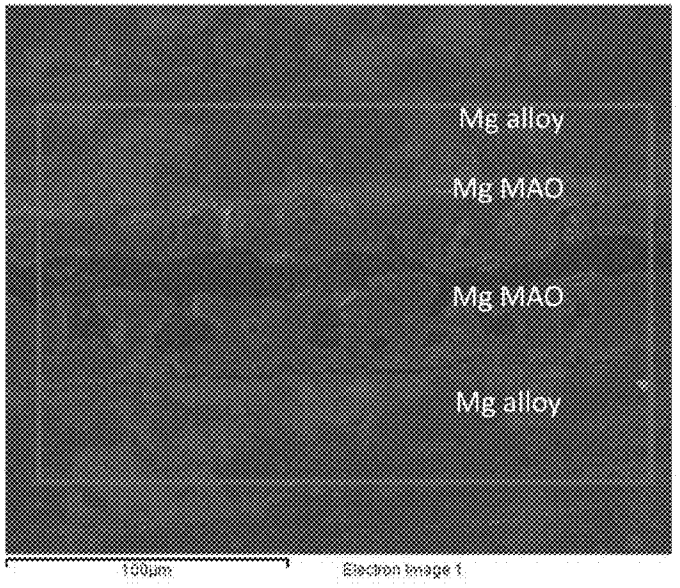
FIG. 1C and FIG. 1D show SEM images of a MAO treated Mg alloy surface and a cross-section thereof, respectively, in accordance with an example embodiment.
Figure 1C:
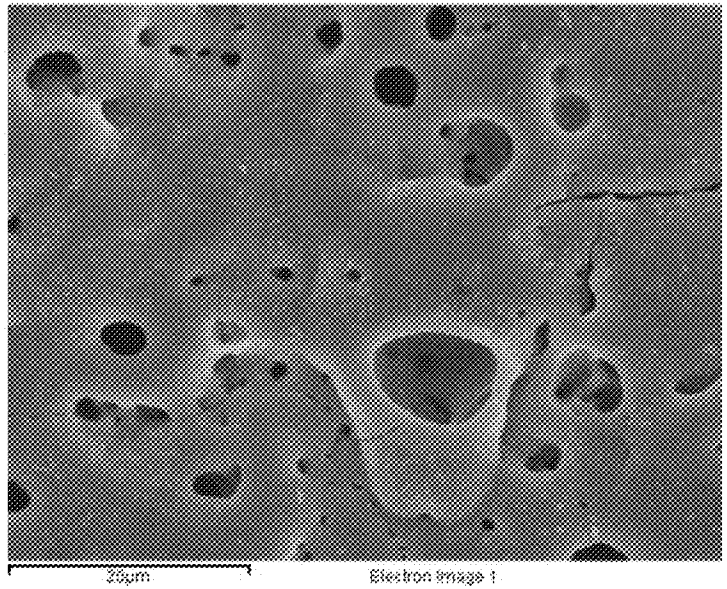

FIG. 1C and FIG. 1D, respectively, show SEM images of a MAO treated Mg alloy surface and a cross-section of the MAO treated Mg alloy surface.

Figure 1F:
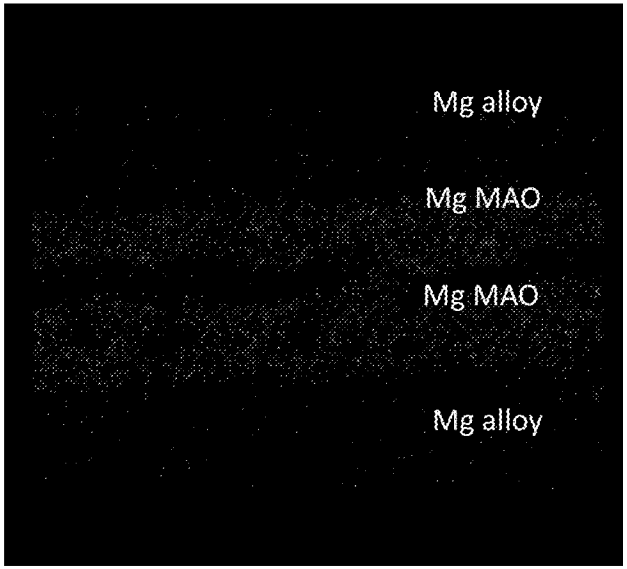
FIG. 1E and FIG. 1F show titanium distribution of a MAO treated Mg alloy surface and a cross-section thereof by EDX, respectively, in accordance with an example embodiment.
Figure 1E:
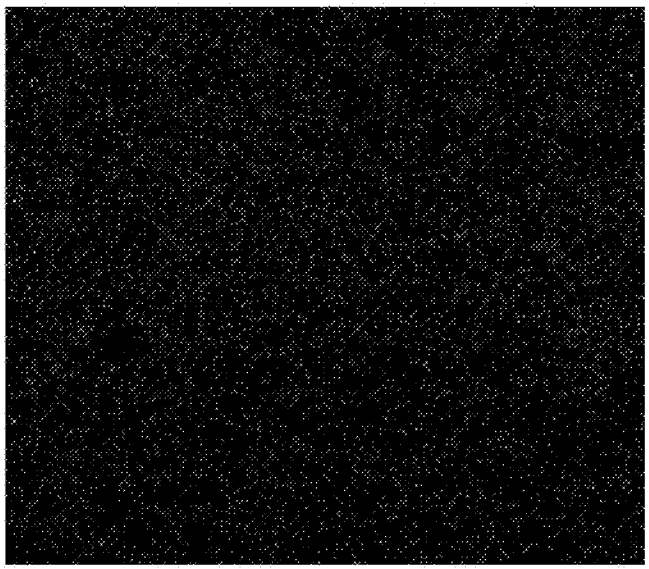

FIG. 1E and FIG. 1F, respectively, show EDX images of titanium distribution on the MAO treated Mg alloy surfaces of FIG. 1C and FIG. 1D, respectively.

Figure 2C:
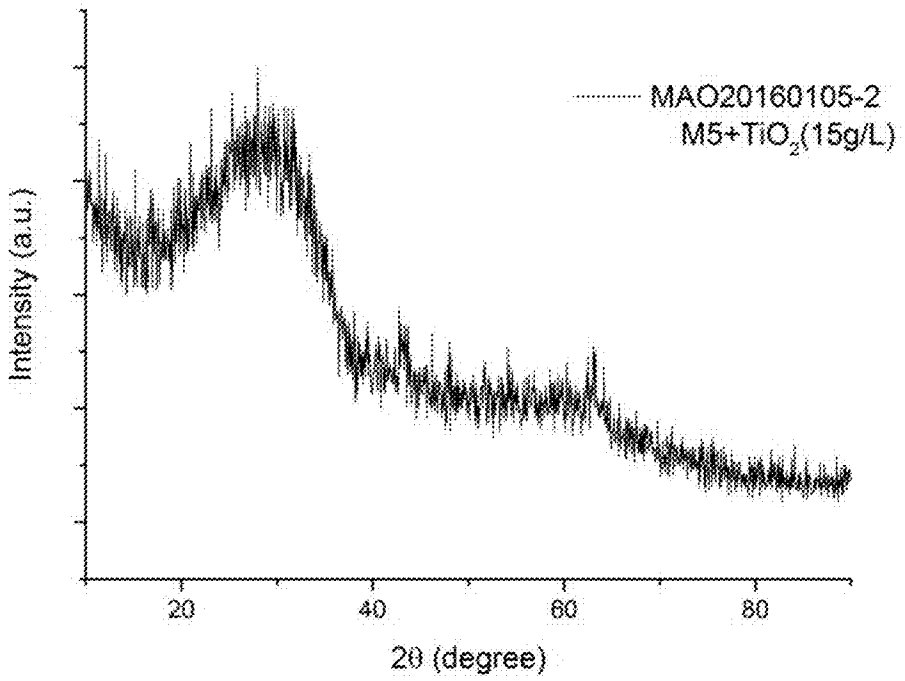
FIG. 2C shows XRD peaks of a MAO treated Mg alloy with 15 g/L titanium dioxide ($TiO_2$) nanoparticles in accordance with an example embodiment.

FIG. 2C shows XRD peaks of MAO treated Mg alloy samples that are treated with 15 g/L $TiO_2$ nanoparticles.

Figure 3:
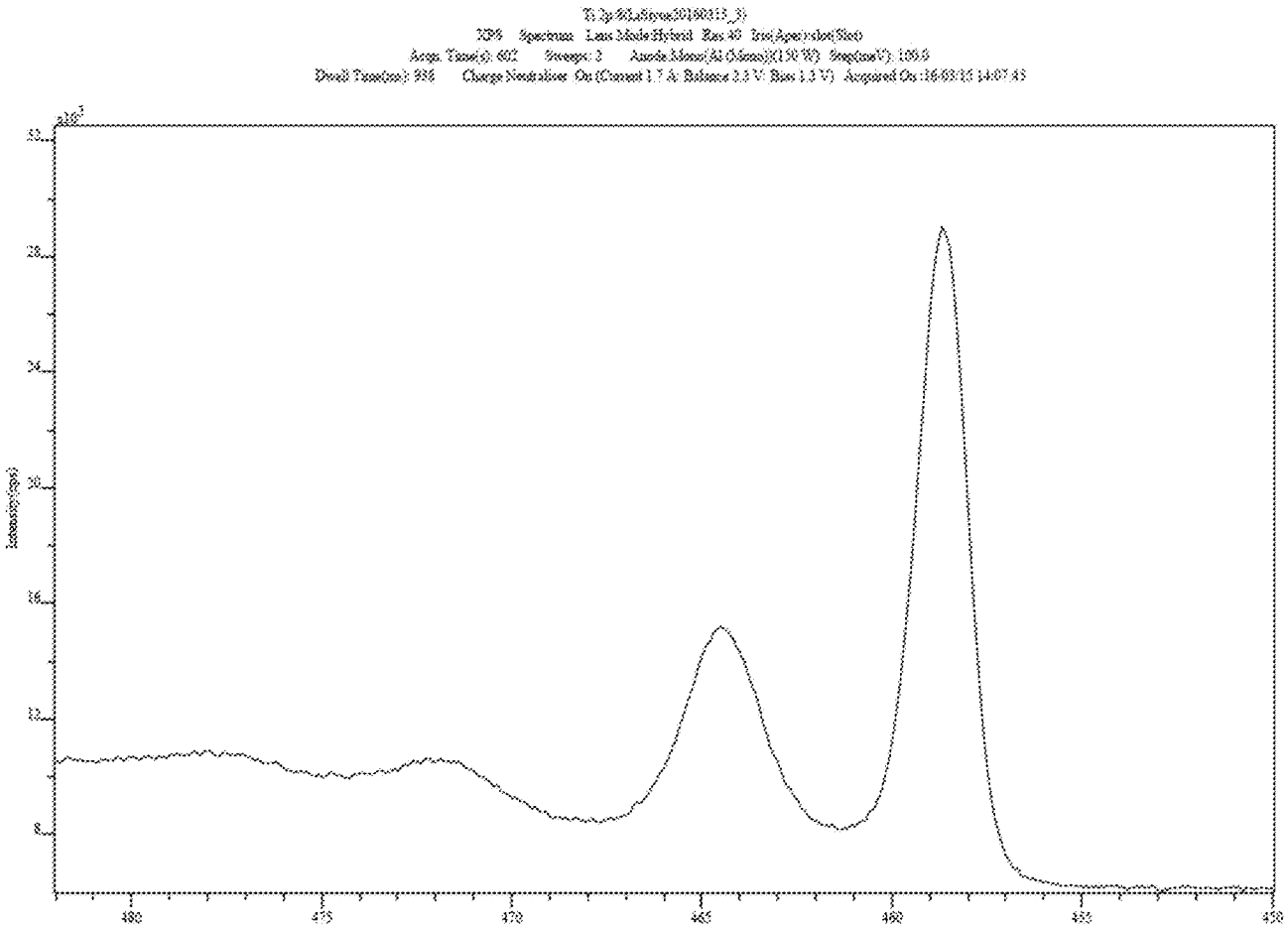
FIG. 3 shows X-ray photoelectron spectroscopy (XPS) peaks of a MAO treated Mg alloy indicating the presence of $Ti2_{p3/2}$ peak and $Ti2_{p1/2}$ of $TiO_2$ in binding energies of 458.5 eV and 464.5 eV respectively in accordance with an example embodiment.

FIG. 3 shows XPS peaks of MAO treated Mg alloy that indicate the presence of $Ti2_{p3/2}$ peak and $Ti2_{p1/2}$ of $TiO_2$ in binding energies of 458.5 eV and 464.5 eV respectively.

Figure 5E:
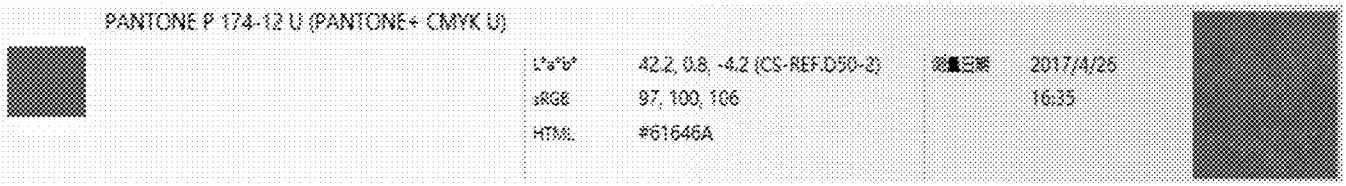
FIG. 5E and FIG. 5F show sRGB values of MAO treated Mg alloy samples with 10 g/L and 15 g/L $TiO_2$ nanoparticles (rutile, 30 nm), respectively, in accordance with an example embodiment.

FIG. 5E shows a sRGB value of (97, 100, 106) for the MAO treated Mg alloy samples that are treated with 10 g/L $TiO_2$ nanoparticles (rutile, 30 nm) in a current density of 0.17 A/cm$^2$ for 210 seconds.

Figure 5F:
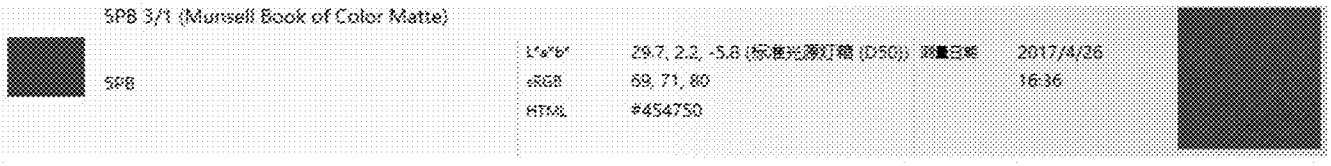

FIG. 5F shows a sRGB value of (69, 71, 80) for the MAO treated Mg alloy samples that are treated with 15 g/L $TiO_2$ nanoparticles (rutile, 30 nm) under an electric current of a current density of 0.17 A/cm$^2$ and of a pulse frequency of 2,600 Hz for 170 seconds. The result indicates when more $TiO_2$ nanoparticles (rutile, 30 nm) are added, a darker surface coloration of MAO treated Mg alloy, as reflected by a smaller sRGB value, can be formed.

Figure 5G:
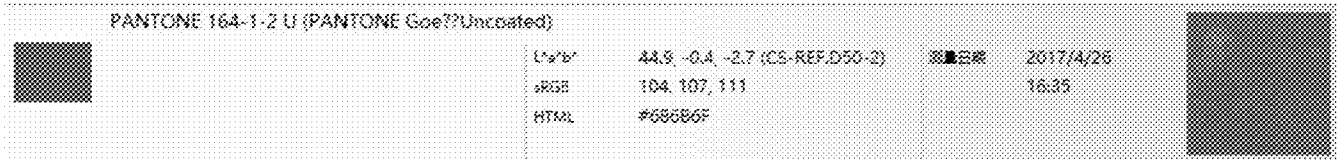
FIG. 5G and FIG. 5H show sRGB values of MAO treated Mg alloy samples with 10 g/L $TiO_2$ nano-particles (rutile, 30 nm) that are processed in current densities of 0.08 A/cm$^2$ and 0.17 A/cm$^2$, respectively, in accordance with an example embodiment.

FIG. 5G shows a sRGB value of (104, 107, 111) for the MAO treated Mg alloy samples that are treated with 10 g/L $TiO_2$ nanoparticles (rutile, 30 nm), and processed under an electric current of a current density of 0.08 A/cm$^2$ and of a pulse frequency of 2,600 Hz for 600 seconds.

Figure 5H:
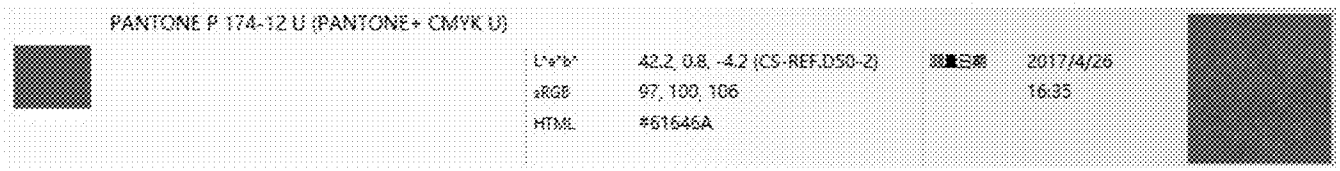

FIG. 5H shows a sRGB value of (97, 100, 106) for the MAO treated Mg alloy samples that are treated with 10 g/L $TiO_2$ nanoparticles (rutile, 30 nm), and processed under an electric current of a current density of 0.17 A/cm$^2$ and of a pulse frequency of 2,600 Hz for 210 seconds. The result indicates when the applied current density is increased, a darker surface coloration of MAO treated Mg alloy, as reflected by a smaller sRGB value, can be formed.

Figure 5I:
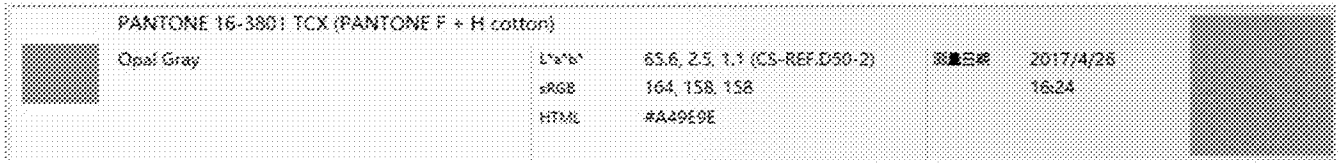
FIG. 5I and FIG. 5J show sRGB values of MAO treated Mg alloy samples with 5 g/L of $TiO_2$ nanoparticles (rutile, 30 nm) that are processed for 140 seconds and 200 seconds, respectively, in accordance with an example embodiment.

FIG. 5I shows a sRGB value of (164, 158, 158) for the MAO treated Mg alloy samples that are treated with 5 g/L of $TiO_2$ nanoparticles (rutile, 30 nm), and processed under an electric current of a current density of 0.11 A/cm$^2$ and of a pulse frequency of 2,600 Hz for 140 seconds.

Figure 5J:
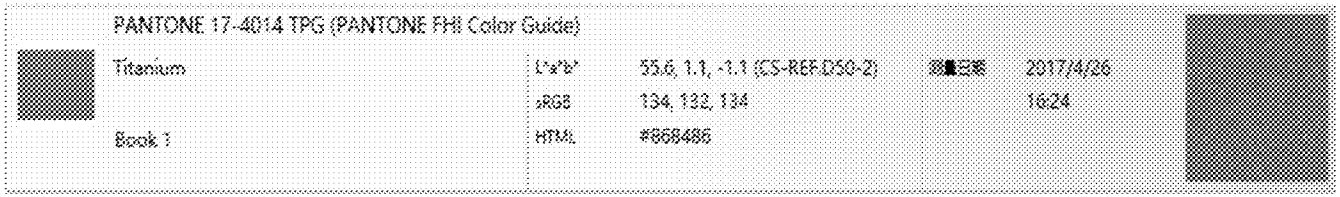

FIG. 5J shows a sRGB value of (134, 132, 134) for the MAO treated Mg alloy samples that are treated with 5 g/L of $TiO_2$ nanoparticles (rutile, 30 nm), and processed under an electric current of a current density of 0.11 A/cm$^2$ and of a pulse frequency of 2,600 Hz for 200 seconds. The result indicates when the treatment time is longer, a darker surface coloration of MAO treated Mg alloy, as reflected by a smaller sRGB value, can be formed.

In another example embodiment, no additional step, such as an annealing step, is required to obtain a MAO treated Mg alloy with an enhanced surface coloration.

In one example embodiment, a MAO treated Mg alloy with a standard color code PANTONE 7540 C can be obtained when 10 g/L $TiO_2$ nanoparticles are added into the electrolyte for MAO treatment, as shown in FIG. 4B.

As used herein, the term "uniformly enhanced" means color of a MAO coating formed in this invention is darker than the conventional white MAO color, in which the sRGB values of the color of the MAO coating formed in this invention is lower than the sRGB values of the conventional white MAO color. The color of the MAO coating formed in this invention is uniform such that the results of the measured PANTONE color code by color meter can be repeated in the same MAO sample.

What is claimed is:

1. A method of treating a surface of a magnesium (Mg) alloy, comprising:

immersing the Mg alloy into an electrolyte; and applying an electric current with a current density of 0.03-0.17 A/cm$^2$ and a pulse frequency of 500-2,600 Hz on the Mg alloy for a time duration of 100-720 seconds, wherein the Mg alloy comprises:

8.3-9.7 weight percent of aluminum (Al);

0.35-1.0 weight percent of zinc (Zn);

0.15-0.50 weight percent of manganese (Mn); and a balanced percent of Mg;

wherein the electrolyte is a mixture of 20-30 g/L silicates, 5-20 g/L phosphate, 3-6 g/L hydroxide, 5-10 g/L glycerol, 0.5-2 g/L tungstate, and 5-15 g/L titanium dioxide ($TiO_2$) nanoparticles in deionized (DI) water, and wherein a color of the surface of the Mg alloy that is treated by the method is uniformly enhanced.

2. The method of claim 1, wherein the silicate is sodium metasilicate nonahydrate.

3. The method of claim 1, wherein the phosphate is sodium pyrophosphate decahydrate.

4. The method of claim 1, wherein the hydroxide is sodium hydroxide.

5. The method of claim 1, wherein the tungstate is sodium tungstate.

6. The method of claim 1, wherein the $TiO_2$ nanoparticle is rutile titanium dioxide with a particle size of 30 nm.

7. A surface-treated magnesium (Mg) alloy, comprising:

a Mg alloy wherein the Mg alloy includes:

8.3-9.7 weight percent of aluminum (Al);

0.35-1.0 weight percent of zinc (Zn);

0.15-0.50 weight percent of manganese (Mn); and a balanced portion of Mg;

a Mg based ceramic layer that has a thickness of 5-40 μm and that is formed on a surface of the Mg alloy; and a layer of Titanium (Ti) that is distributed in the Mg based ceramic layer, wherein the Mg based ceramic layer uniformly enhances a color appearance of the surface of the Mg alloy.

8. The surface-treated magnesium (Mg) alloy of claim 7, wherein the surface-treated Mg alloy has a sRGB value of (97, 100, 106), (69, 71, 80), (104, 107, 111), (164, 158, 158), or (134, 132, 134).

9. The surface-treated magnesium (Mg) alloy of claim 7, wherein the surface-treated Mg alloy is made by the method of claim 1.

* * * * *